United States Patent [19]

Musil

[11] Patent Number: 4,702,642

[45] Date of Patent: Oct. 27, 1987

[54] EXTENSIBLE SCREED ASSEMBLY FOR A BITUMINOUS PAVER

[75] Inventor: Joseph E. Musil, Ely, Iowa

[73] Assignee: Cedarapids, Inc., Cedar Rapids, Iowa

[21] Appl. No.: 889,234

[22] Filed: Jul. 25, 1986

[51] Int. Cl.[4] ..... E01C 19/22

[52] U.S. Cl. ..... 404/118; 404/96

[58] Field of Search ..... 404/96, 114, 104, 118–120; 425/456, 458; 172/815

[56] References Cited

U.S. PATENT DOCUMENTS

| | | | |
|---|---|---|---|
| 3,557,672 | 1/1971 | Schurtz et al. | 404/118 X |
| 4,272,213 | 6/1981 | McGovarin | 404/118 |
| 4,345,852 | 8/1982 | Goto et al. | 404/118 X |
| 4,364,690 | 12/1982 | Bruns | 404/118 |
| 4,379,653 | 4/1983 | Brown | 404/118 |

*Primary Examiner*—Stephen J. Novosad
*Assistant Examiner*—John F. Letchford
*Attorney, Agent, or Firm*—Simmons, Perrine, Albright & Ellwood

[57] ABSTRACT

An extensible screed assembly for a bituminous paver incorporates a pair of screed extensions which are movable laterally outwards of the paver in order to pave roadway widths greater than that of the main screed. The screed extensions feature means by which the attack angle of each extension can be adjusted relative to the attack angle of the main screed and by which the alignment of each extension can also be adjusted relative to that of the main screed.

12 Claims, 7 Drawing Figures

EXTENSIBLE SCREED ASSEMBLY FOR A BITUMINOUS PAVER

BACKGROUND OF THE INVENTION

Most paving machines now-a-days for laying bituminous or asphalt roadways are of the so-called "floating screed" kind. Each employs a tracked or wheeled tractor unit having a pair of rearwardly extending screed pull arms pivoted to its sides, the screed assembly itself being attached to the rear ends of the pull arms. In this type of paver the texture and density of the mat is influenced by the weight of the screed assembly, since it "floats" upon the material beneath it, and by the angular attitude of the underlying screeding surface relative to the roadway, known as the "attack angle" of the screed. For a given paving speed the thicker the mat being laid the greater the attack angle must be in order to achieve a required mat density. Hence the screed assembly in turn must be pivoted relative to the pull arms about a transverse axis so that the attack angle can be adjusted on the run as conditions dictate.

A typical width of the screed assembly of a paver for highway and the like construction is ten feet, approximately the overall width of the paver itself. In order to lay a mat of greater width, and so reduce the number of passes needed, extensible screed assemblies are commonly used. These include a pair of shorter screeds, or "screed extensions" as they are often called, carried by and disposed rearwardly of the main screed, being attached to the latter so that one or both can be slid longitudinally outwards of the main screed and so extend the effective width of the latter up to twofold. The overall width of the mat laid in a single pass is thereby increased and also the efficiency of the paver in terms of time and cost needed to pave a given roadway. But inherent in the use of screed extensions are certain deficiencies which have not been recognized or if recognized have simply been ignored in practice.

These deficiencies arise from the fact that as the width of the screed assembly is increased by the extensions the weight upon the portion or portions of the mat being laid by the extensions as well as the main screed decreases, especially towards the outer ends of the extensions. The result is a mat of uneven or variable texture and density. Another problem results when one screed extension strikes a curb, a manhole cover or the like, a not infrequent or isolated occurrence during some paving conditions. The screed extension is thereby often thrown out of alignment with the main screed, thus altering the effect of the attack angle of the extension on the mat and so the texture of the latter. Accordingly, the chief object of the present invention is an improved extensible screed assembly which eliminates or at least reduces the deficiencies mentioned as well as incorporating other improvements in structure and ease of operation.

SUMMARY OF THE INVENTION

The invention modifies the screed assembly so that the attack angle of each screed extension can be adjusted on the run, if necessary, relative to that of the main screed. Hence, especially when the screed assembly is fully extended, the attack angle of one or both extensions can be increased to compensate for the fact that the weight upon the mat, especially adjacent its lateral edges, is decreased. The texture and density of the overall mat is thus more uniform. In addition, the alignment of each screed extension can be adjusted relative to that of the main screed in order to correct any misalignment resulting from the extension bumping a curb or the like. Other features and advantages of the extensible screed assembly illustrated in the drawing and later described in more detail will be apparent.

DETAILED DESCRIPTION OF THE PREFERRED EMBODIMENT

Figure 1:
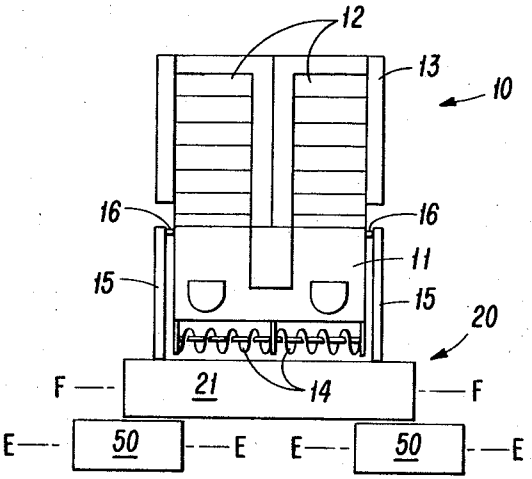
FIG. 1 is a diagrammatic top plan view of a typical bituminous paver having an extensible screed assembly according to the invention, the screed extensions being shown partially extended.

As shown in FIG. 1 a typical bituminous paver 10 includes a tractor unit 11 having slat conveyors 12 to carry the mix from the hopper 13 rearwardly to the spreader augers 14. The forward ends of a pair of screed pull arms 15 are journaled at 16 to the sides of the tractor 11 and extend rearwardly, being connected at their rear ends to an extensible screed assembly, generally denoted at 20, disposed transversely across the rear of the tractor 11.

Figure 4:
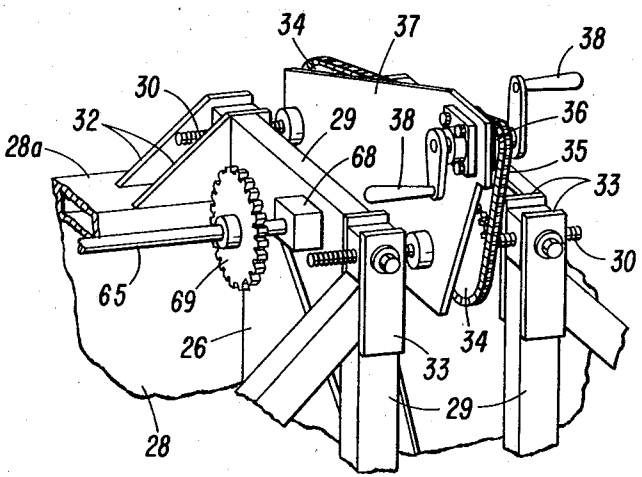
FIG. 4 is a detail view of the slope control for the screed assembly.
Figure 2:
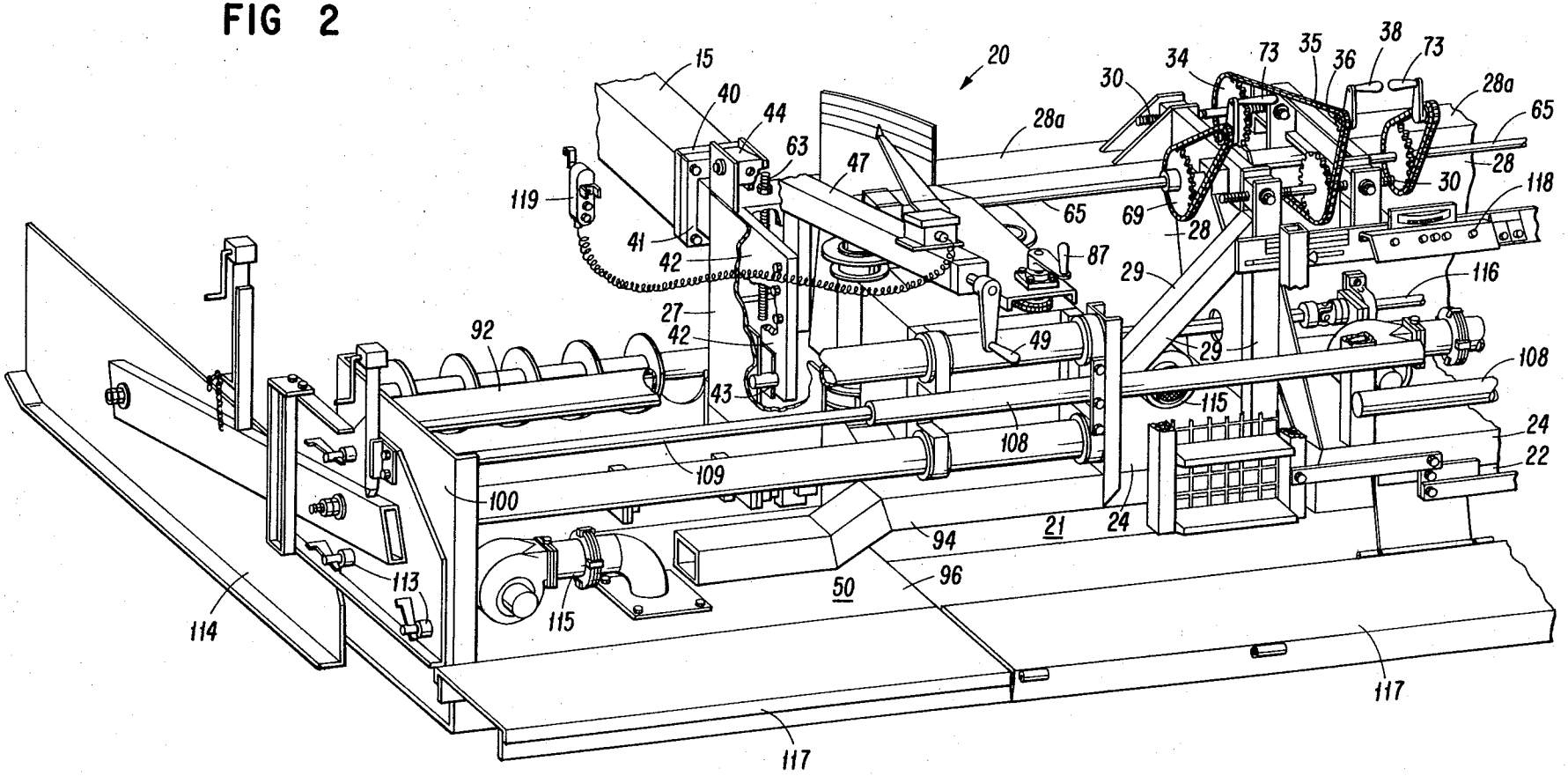
FIG. 2 is a partial rear perspective view of the extensible screed assembly of the invention, the lefthand extension being shown fully extended.
Figure 5:
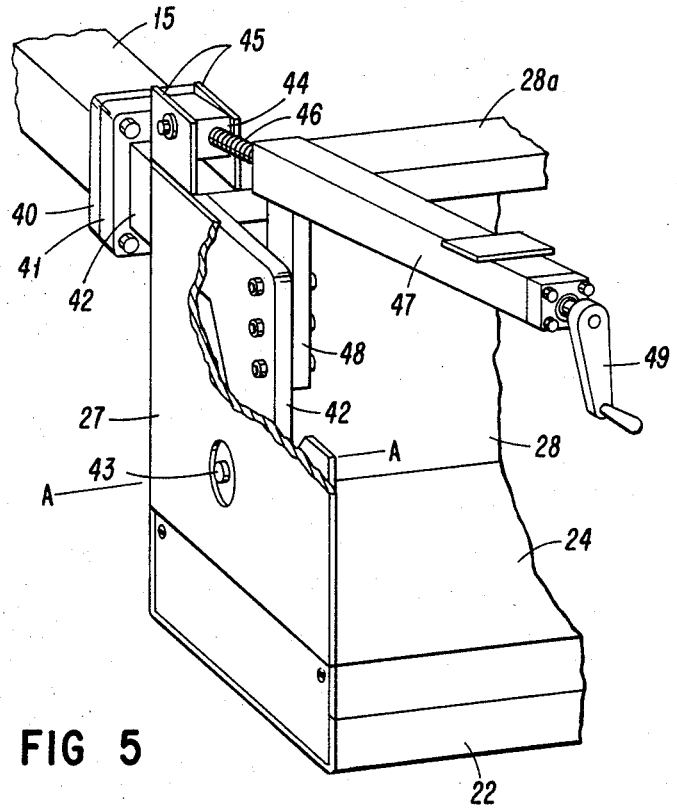
FIG. 5 is a detail view illustrating the lefthand control for the attack angle of the entire screed assembly.

The screed assembly 20 (see FIG. 2) comprises a main screed 21 (see FIGS. 3–5) divided into left and right hand halves but having a common underlying U-shaped screed plate 22 providing an underlying screeding surface 22*a*. The walls of the screed plate 22 are notched at 23 at its midpoint so that the slope of each half can be adjusted relative to the other in order to vary the crown of the main screed 21. Atop each screed half is an inverted U-shaped floor plate 24 to which the screed plate 22 is attached in conventional manner as by J-bolts 25. Each floor plate 24 carries a pair of upstanding, flanged inner and outer end plates 26 and 27, a front wall plate 28 having a top flange 28*a*, and an upstanding truss 29 adjacent the inner end plate 26 and tied into the front wall plate 28. Slope control is provided by a pair of oppositely threaded screw shafts 30 between the screed halves which engage threaded blocks 31 journaled between brackets 32 and 33 mounted atop the front wall flanges 28*a* and the trusses 29. To the midpoints of the screw shafts 30 are fixed a pair of driven sprockets 34. A drive chain 35 passes about the sprockets 34 and up over a smaller drive sprocket 36 journaled on an upstanding bracket plate 37 on the screw shafts 30. A pair of hand cranks 38 drive the sprocket 36, whence rotation of the latter will rotate the screw shafts 30 and thus adjust the crown of the entire screed assembly 20 about its mid-point 23.

The screed assembly 20 is bolted to flanges 40 at the rear ends of the screed pull arms 15. The flanges 40 in turn engage mating flanges 41 at the forward ends of heavy L-shaped pivot brackets 42 (only the left-hand one being shown) passing through the upper outer corners of the screed front wall plates 28 and then down along the inside of the screed outer end plates 27, the lower ends of the brackets 42 being pivoted at 43 to the end plates 27. Attack angle adjustment is provided by threaded blocks 44 (only the left-hand one being shown) journaled between brackets 45 atop the front wall flanges 28*a*, the blocks 44 receiving screw shafts 46 carried within rearwardly extending, boxed housings 47 secured to bracket plates 48 bolted to the elbows of the pivot brackets 42. The screw shafts 46 are journaled in the rear ends of the housings 47 and fitted with hand cranks 49. Thus rotation of the latter adjusts the attack angle or fore-and-aft inclination of the entire screed assembly 20 by moving the latter about the axis A—A (see FIG. 5) of the two pivots 43.

Figure 6:
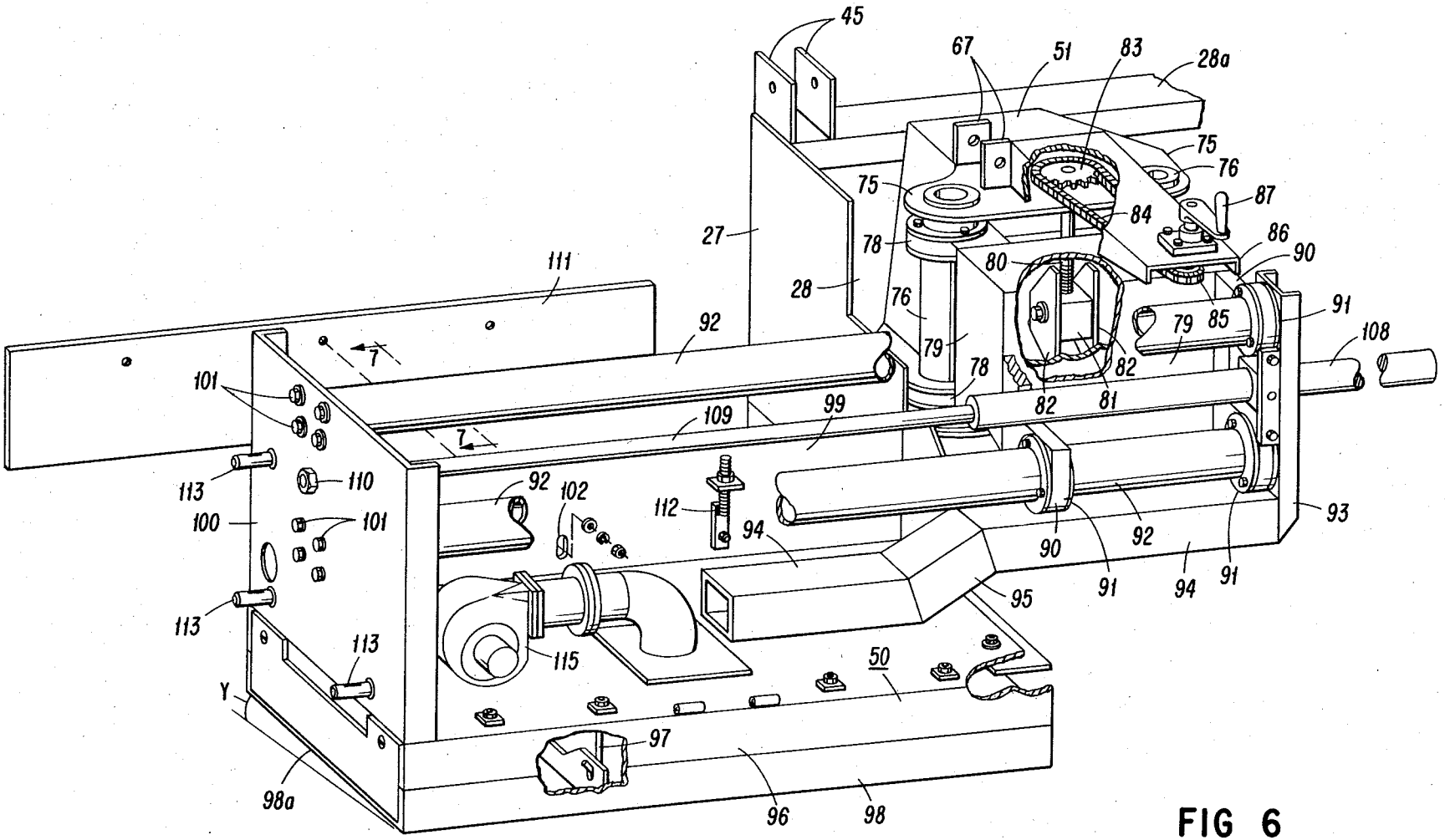
FIG. 6 is a perspective view of the lefthand screed extension showing the manner in which it is mounted to the main screed and the manner by which its elevation is controlled relative to the main screed.

Each screed extension, generally designated at 50 (only the left-hand one being shown in FIGS. 2 and 6 and described since both are identical in structure and operation), is attached to the main screed 21 through a large box frame 51, fabricated from steel plate, having a lower leg 52 disposed transversely across an outer end of the main screed plate 22, the floor plate 24 being relieved at 53 for that purpose. A shaft 54, fixed to the frame leg 52, extends therethrough transversely of the screed plate 22, the rear end of the shaft 54 being journaled in a split bearing 55 mounted to the screed plate 22. The front end of the shaft 54 is also journaled in a split bearing 56, bolted at 57 to the front wall plate 28, the bolt holes in the latter being enlarged for purposes to be described. From FIG. 3 it will be seen that the top half of the bearing 56 extends upwardly and its mid-portion is provided with a pair of shoulders in the form of ramps. The latter are engaged by a pair of cooperative wedge blocks 58 having tongues which extend through vertical slots 59 in the wall plate 28. The wedge blocks 58 are held to the bearing 56 by slotted clamp plates 60 and bolts 61. To the top of the bearing 56 is bolted a block 62 to which in turn is welded the lower end of a threaded rod 63 which extends up through the front wall flange 28*a* and is captured there between two nuts 64 (only one being shown). Movement of the box frame 51 about the axis of the shaft 54 is controlled by a screw shaft 65 threaded at its outer end into a pivot block 66 journaled between a pair of bracket plates 67 welded to the top of the frame 51. The other end of the screw shaft 65 is journaled in a bearing 68 attached to the horizontal portion of the truss 29 adjacent which a driven sprocket 69 is fixed to the screw shaft 65. A drive chain 70 is entrained around the sprocket 69 and smaller drive sprocket 71 journaled in a supporting bracket 72 attached to the truss 29, the sprocket 71 being fitted with a hand crank 73. Hence by rotating the crank 73 the frame 51 will be tilted back and forth on the shaft 54 about its axis B—B (see FIG. 3) relative to the main screed 21.

Each box frame 51 is provided with a pair of vertically spaced, horizontal bracket plates 75 extending rearwardly from the frame 51 to which are welded the ends of a pair of laterally spaced vertical steel tubes 76. Each of the latter receives a pair of bearings 77 (only two being shown in FIG. 3) retained within a pair of vertically spaced brackets 78 extending forwardly from a second box frame 79 such that the latter frame can slide up and down on the tubes 76 relative to the frame 51. That movement in turn is controlled by a vertical screw shaft 80 (see FIG. 6) threaded into a pivot block 81 journaled between a pair of bracket plates 82 on the front face of the frame 79. The screw shaft 80 extends upwards between the tubes 76 and is journaled in the upper bracket plate 75, its upper end being fitted with a driven sprocket 83. A drive chain 84 passes around the sprocket 83 and a smaller drive sprocket 85 journalled in a rearwardly extending channel 86 welded to the top of the frame 51, the sprocket 85 being fitted with a hand crank 87. Thus rotation of the latter will move the frame 79 up and down along an axis C—C (see FIG. 3) relative to the frame 51.

Figure 7:
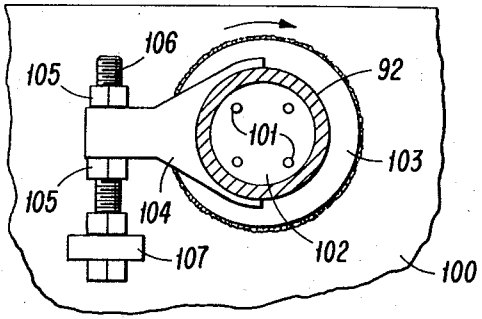
FIG. 7 is a detail view taken along the line 7—7 of FIG. 6.

From the rear face of the frame 79 extends a pair of laterally spaced vertical brackets 90 (see FIGS. 3 and 6) into which are fitted two pairs of bearings 91, like the bearings 77, which slidably receive a pair of vertically spaced, horizontal steel tubes 92 whose inner ends are joined by a vertical channel member 93. To the lower end of the latter is welded the inner end of a box beam 94 extending out beyond the end of the main screed 21, the outer portion of the beam 94 being offset rearwardly at 95 and welded to the top of the floor plate 96 of the screed extension 50, the latter thus being offset rearwardly of the main screed 21. Beneath the floor plate 96 and attached by J-bolts 97, is the screed plate 98 of the extension 50 having an underlying screeding surface 98*a*. Welded to the floor plate 96 are a low front wall plate 99 and a flanged outer end plate 100, the outer ends of the tubes 92 being bolted at 101 through the end plate 100 into plugs 102 (only one being shown in FIG. 7) welded in the outer ends of the tubes 92, the latter being received in flanges 103 welded to the inboard face of the end plate 100. The end of the lower tube 92 only is welded in turn to its flange 103 while to the end of the upper tube 92 are welded the arms of a yoke 104 just inboard of the flange 103. The shank of the yoke 104 is captured between two nuts 105 on a vertical bolt 106 secured to a bracket 107 welded to the end plate 100. As the extension 50 is being attached to the upper tube 92 the nuts 105 are rotated one to two turns which imposes a pre-torque load in the direction indicated by the arrow in FIG. 7 on the tube 92, the holes for the upper bolts 101 in the end plate 100 being slotted for that purpose. The rigidity of the entire extension 50 relative to the main screed 21 is thus increased because the twisting force imposed upon the tubes 92 by the mix ahead of the extension 50 during paving is better resisted. Hence the entire extension 50 is supported by the tubes 92 and the beam 94 and slides in and out through the bearings 91 longitudinally of the main screed 21 to retract and extend the width of the screed assembly 20.

Movement of each extension 50 is controlled, as is typical, by a pair of hydraulic rams 108 secured to the main screed 21, its piston rods 109 being bolted at 110 in turn to the extension end wall 100. The forward face of the extension screed plate 98 (as is that of the main screed 21) is provided with a strike-off plate 111, vertical adjustment of which is provided at 112 on the front wall plate 99. Provision is also made at 113 for attaching typical cut-off shoes 114 (see FIG. 2) or screed extenders to the outer ends of the extensions 50. The screed assembly 20 of course includes many other typical items such as burners 115, vibrators 116, telescoping walkways 117, various additional controls 118, etc., all as will be apparent to those of skill in the art, including a pair of movable "handsets" 119 (only one being shown in FIG. 2) for the screed man or men, each of which handsets carries a switch for activating the rams 108 to extend or retract extensions 50, an override switch for its associated auger 14, and a horn button.

Figure 3:
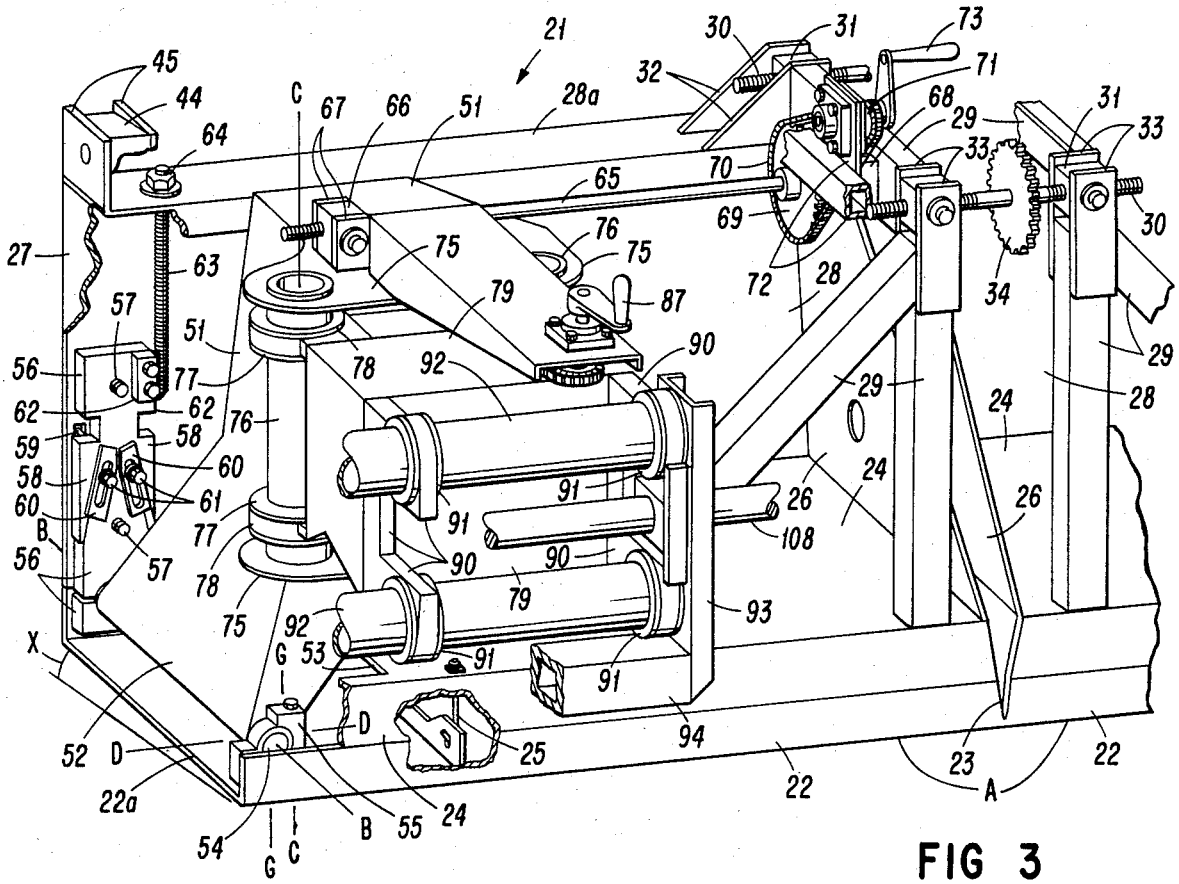
FIG. 3 is a rear perspective view of the lefthand portion of the main screed of FIG. 2 illustrating the slope, attack angle and alignment controls for the lefthand screed extension.

As previously noted, rotation of the cranks 38 will adjust the slope of each half of the entire screed assembly 20 in directions transversely of that of the roadway, that is, the angle the screeding surfaces 22*a* and 98*a* of one half make with those of the other half, as indicated at "A" in FIG. 3. Likewise, as previously noted, rotation of one or both cranks 49 will adjust the attack angle or fore-and-aft inclination of the entire screed assembly 20 about the axis A—A, that is, the inclination the screeding surfaces 22*a* and 98*a* relative to the direction of the roadway, as indicated at "X" and "Y", respectively, in FIGS. 3 and 6. Since each extension 50 is connected to the main screed 21 through the box frame 51, rotation of one or both cranks 73 will adjust the slope, in the foregoing sense, of one or both extensions 50 relative to that of their respective halves of the main screed 21 about the axes B—B parallel to the screeding surfaces 98*a*. And because each extension 50 is connected to its respective box frame 51 through the box frame 79, rotation of each crank 87 will raise or lower its respective extension 50 in along the axis C—C normal to its screeding surface 98*a* and thus the elevation of the latter surface relative to the surface 22*a* of the main screed 21 so that the two surfaces can be made co-planar.

When it becomes desirable, for the reason mentioned, to increase the attack angle of one (or both) extension 50 relative to that of the main screed 21, the bolts 57 of the bearing 56 are loosened and the nuts 64 on the rod 63 adjusted so that the entire bearing 56 is raised, thus tilting the box frame 51 about another axis D—D (see FIG. 3) transversely of the screed pull arms 15 and hence increasing the attack angle or fore-and-aft inclination "Y" of the screed extention 50 relative to the inclination "X" of the main screed 21. This can be accomplished on the run by one of the screed men, after which the bolts 57 are retightened. Should one extension 50 strike an obstacle and disturb its alignment with the main screed 21 such that the longitudinal axis of the extension 50, indicated by the line E—E in FIG. 1, is no longer in a plane parallel to a plane through the longitudinal axis of the main screed 21, indicated by the line F—F in FIG. 1, the bearing bolts 57 and 61 are first loosened. Then the wedge blocks 58 are vertically adjusted in opposite directions on the ramps of the bearing 56, thus moving the latter longitudinally of the main screed plate 22 and so pivoting the entire screed extension 50 about a vertical axis G—G (see FIG. 3) relative to the screed extension surface 98*a*, whereby the axis E—E of the extension 50 can be shifted to correct the misalignment, after which the bolts 57 and 61 are retightened. In practice it has been found that the bearings 55 and 56 readily accommodate the relatively small misalignments with the shaft 54 caused by vertical and horizontal movements of the bearing 56, which movement is permitted owing to the enlarged holes in the front wall plate 28 for the bolts 57. Other aspects of the structure and operation of the screed assembly 20 will be apparent to those of skill in the art.

Though the invention has been described in terms of a particular embodiment, being the best mode known of carrying out the invention, it is not limited to that embodiment alone. Instead the following claims are to be read as encompassing all adaptations and modifications of the invention falling within its spirit and scope, in which claims the terms "inclination", "slope", "elevation", and "alignment" have the above meanings.

I claim:

1. In an extensible screed assembly for use with a bituminous paving machine having a tractor unit with a pair of screed pull arms pivoted at their forward ends to the sides of the tractor unit and extending rearwardly therefrom, the screed assembly being attachable transversely across the rear ends of the screed pull arms and having first inclination adjusting means for pivoting the entire screed assembly relative to the screed pull arms about a screed assembly inclination axis transversely of the screed pull arms effective to adjust the fore-and-aft inclination of the entire screed assembly relative to a roadway, the screed assembly including a main screed and a pair of screed extensions offset rearwardly of the main screed, each of the screed extensions being longitudinally moveable in opposite directions relative to the main screed effective to adjust the overall width of the screed assembly, the main screed and screed extensions having underlying planar screeding surfaces, the improvement comprising: second inclination adjusting means pivoting each of the screed extensions relative to the main screed about screed extension inclination axes transversely of the screed pull arms effective to selectively adjust on the run the fore-and-aft inclination of each of said screed extension surfaces relative to the fore-and-aft inclination of said main screed surface.

2. The screed assembly of claim 1 including alignment adjusting means pivoting the screed extension surfaces relative to the main screed surface about screed extension alignment axes generally normal to the screed extension surfaces effective to selectively adjust the on the run alignment of each screed extension surface relative to the alignment of the main screed surface.

3. The screed assembly of claim 2 including slope adjusting means pivoting the screed extension surfaces relative to the main screed surface about screed extension slope axes generally parallel to the screed extension surfaces effective to selectively adjust on the run the slope of each screed extension surface relative to the slope of the main screed surface.

4. The screed assembly of claim 3 including elevation adjusting means effective to selectively adjust on the run the elevation of each screed extension surface relative to the elevation of the main screed surface in directions generally normal to the screed extension surfaces.

5. The screed assembly of claim 1 including elevation adjusting means effective to selectively adjust on the run the elevation of each screed extension surface relative to the elevation of the main screed surface in a direction generally normal to the screed extension surface.

6. The screed assembly of claim 5 including slope adjusting means pivoting the screed extension surfaces relative to the main screed surface about screed extension slope axes generally parallel to the screed extension surfaces effective to selectively adjust on the run the slope of each screed extension surface relative to the slope of the main screed surface.

7. The screed assembly of claim 6 including alignment adjusting means pivoting the screed extension surfaces relative to the main screed surface about screed extension alignment axes generally normal to the screed extension surfaces effective to selectively adjust on the run the alignment of each screed extension surface relative to the alignment of the main screed surface.

8. The screed assembly of claim 1 wherein each screed extension is longitudinally offset rearwardly of the main screed, the main screed having opposite ends, and including means mounting the screed extensions to the main screed, the mounting means for each screed extension comprising: a first frame extending upright from the main screed and having lower portions disposed adjacent one end of the main screed; a pair of spaced pivot means pivotally connecting said frame portions to the main screed about an axis transversely of and generally parallel to the screed extension surface; a second frame disposed rearwardly of the first frame; sliding means interconnecting the first and second frames for slidable movement of the second frame relative to the first frame in alternate directions generally normal to the screed extension surface, whereby to alter the elevation of the second frame relative to the first frame; screed extending means disposed rearward of the second frame interconnecting the second frame and the screed extension for longitudinal movement of the screed extension in opposite directions relative to the main screed whereby to adjust on the run the overall width of the screed assembly; slope adjusting screw means interconnecting the main screed and said first frame for pivoting the first frame and thereby the screed extension about said pivot means whereby to adjust on the run the slope of the screed extension surface relative to the slope of the main screed surface; elevation adjusting screw means interconnecting the first and second frames for altering on the run the elevation of the second frame as aforesaid; hydraulic power means interconnecting the second frame and the screed extension for longitudinal movement of the screed extension as aforesaid; and control means controlling operation of the hydraulic power means.

9. The screed assembly of claim 8 wherein the sliding means includes a pair of laterally spaced upright tubes carried by one of said frames and two pairs of first bearings carried by the other of said frames, the bearings of each pair being vertically spaced from each other and slidably receiving one of said tubes; and wherein the screed extending means includes a pair of vertically spaced generally horizontal tubes secured at their respective ends to longitudinally spaced portions of the screed extension, and two pairs of second bearings carried by the rear of the second frame, the bearings of each pair being laterally spaced from each other and slidably receiving one of said horizontal tubes.

10. The screed assembly of claim 9 wherein the screed extension includes an upright outer end wall constituting one of said longitudinally spaced portions of the screed extension, respective ends of said horizontal tubes being secured to said end wall, and including means operative between one of said horizontal tubes and said end wall effective to impose a pretorque load upon said one tube.

11. The screed assembly of claim 8 wherein one of said pivot means is movable relative to the main screed in opposite directions generally normal to the main screed surface effective to adjust on the run the fore-and-aft inclination of the screed extension surface relative to the fore-and-aft inclination of the main screed surface; and including screw means for adjusting on the run the fore-and-aft inclination of the screed extension relative to the fore-and-aft inclination of the main screed, said screw means interconnecting said one pivot means and the main screed for movement of said one pivot means as aforesaid.

12. The screed assembly of claim 11 wherein said one pivot means is adjustable in opposite directions generally longitudinally of the main screed effective to adjust on the run the alignment of the screed extension surface relative to the alignment of the main screed surface.

* * * * *